US011181059B2

(12) United States Patent
Agnus et al.

(10) Patent No.: US 11,181,059 B2
(45) Date of Patent: Nov. 23, 2021

(54) METHOD AND SYSTEM FOR VALIDATING THE PHASE OF A VEHICLE ENGINE

(71) Applicants: CONTINENTAL AUTOMOTIVE FRANCE, Toulouse (FR); CONTINENTAL AUTOMOTIVE GMBH, Hannover (DE)

(72) Inventors: Yves Agnus, Toulouse (FR); Julien Lefevre, Tournefeuille (FR)

(73) Assignees: CONTINENTAL AUTOMOTIVE FRANCE, Toulouse (FR); CONTINENTAL AUTOMOTIVE GMBH, Hannover (DE)

( * ) Notice: Subject to any disclaimer, the term of this patent is extended or adjusted under 35 U.S.C. 154(b) by 0 days.

(21) Appl. No.: 16/650,005

(22) PCT Filed: Oct. 8, 2018

(86) PCT No.: PCT/FR2018/052473
§ 371 (c)(1),
(2) Date: Mar. 24, 2020

(87) PCT Pub. No.: WO2019/073154
PCT Pub. Date: Apr. 18, 2019

(65) Prior Publication Data

US 2020/0277905 A1 Sep. 3, 2020

(30) Foreign Application Priority Data

Oct. 9, 2017 (FR) ..... 1759438

(51) Int. Cl.
*F02D 41/00* (2006.01)
*F02D 41/06* (2006.01)
*F02D 41/38* (2006.01)

(52) U.S. Cl.
CPC ..... *F02D 41/009* (2013.01); *F02D 41/062* (2013.01); *F01L 2820/041* (2013.01);
(Continued)

(58) Field of Classification Search
CPC ..... F02D 2041/0092; F02D 41/009; F02D 2200/0602; F02D 41/062; F02D 41/3845; F01L 2820/041
See application file for complete search history.

(56) References Cited

U.S. PATENT DOCUMENTS 5,402,675 A * 4/1995 Entenmann ..... F02D 41/36 73/114.07
5,970,784 A * 10/1999 Genin ..... F02D 41/009 340/441

(Continued)

FOREIGN PATENT DOCUMENTS

DE 19947764 4/2001
DE 10115262 10/2002

(Continued)

OTHER PUBLICATIONS

International Search Report, PCT/FR2018/052473, dated Mar. 14, 2019.

*Primary Examiner* — Carl C Staubach
(74) *Attorney, Agent, or Firm* — Nixon & Vanderhye

(57) ABSTRACT

Disclosed is a method for determining the configuration of a combustion engine of a motor vehicle including a step of detecting the reference position of the crankshaft, a step of controlling the control valve of the injection pump, after a predetermined time interval, a step of measuring a fuel pressure value in the injection rail, and a step of determining a first configuration of the engine when the fuel pressure value measured in the injection rail is greater than or equal to a first predetermined pressure threshold or determining a second configuration of the engine when the fuel pressure (Continued)

value measured in the injection rail is between a second predetermined pressure threshold and a third predetermined pressure threshold.

15 Claims, 4 Drawing Sheets

(52) U.S. Cl.
CPC .. *F02D 41/3845* (2013.01); *F02D 2041/0092* (2013.01); *F02D 2200/0602* (2013.01)

(56) References Cited

U.S. PATENT DOCUMENTS 6,871,633 B1 * 3/2005 Date ..... F02D 33/006 123/445
7,874,281 B2 1/2011 Delp et al.
2001/0025625 A1 * 10/2001 Schneider ..... F02D 41/009 123/406.58
2007/0213918 A1 * 9/2007 Achleitner ..... G05D 16/2013 701/101
2008/0196485 A1 * 8/2008 Akimoto ..... F02D 35/027 73/114.02
2009/0320795 A1 * 12/2009 Delp ..... F02D 41/009 123/447
2010/0180863 A1 * 7/2010 Gwidt ..... F02D 41/062 123/357
2013/0090833 A1 4/2013 Lachaize et al.
2020/0340412 A1 * 10/2020 Agnus ..... F02D 41/22

FOREIGN PATENT DOCUMENTS

DE 102006031569 3/2008
DE 102008010053 10/2009
DE 102013223626 5/2015
WO 2008/003550 A1 1/2008

* cited by examiner

METHOD AND SYSTEM FOR VALIDATING THE PHASE OF A VEHICLE ENGINE

BACKGROUND OF THE INVENTION

Field of the Invention

The invention relates to the field of synchronization of a combustion engine and relates more specifically to a method and a system for determining the position of a crankshaft of a combustion engine in order to inject fuel into the cylinders as a function of the position of the camshaft.

The invention aims in particular to determine the configuration in which a combustion engine is by determining the position of the crankshaft of said engine without injecting fuel into the engine cylinders, in order to reduce the level of polluting emissions.

Description of the Related Art

As is known, a combustion engine of a motor vehicle comprises hollow cylinders each delimiting a combustion chamber into which a mixture of air and fuel is injected. This mixture is compressed in the cylinder by a piston and ignited so as to make the piston move in translation inside the cylinder. The movement of the pistons in each cylinder of the engine causes a drive shaft known as the "crankshaft" to rotate, making it possible, via a transmission system, to drive the wheels of the vehicle in rotation.

More specifically, a four-stroke engine successively comprises, for each cylinder, four operating phases: a phase for the intake of air and fuel into the combustion chamber of the cylinder, a phase of compressing the mixture obtained, at the end of which it will be combusted, a phase of expanding the gases resulting from the combustion of the mixture, generating the thrust of the piston, and a phase of exhausting the gases from the combustion chamber.

The air of the mixture is injected into the combustion chamber via one or more intake valves, which are regularly open (during the intake phase) and closed (during the other phases). Similarly, the gases resulting from the air-fuel mixture are expelled during the exhaust phase through one or more exhaust valves. As is known, the opening and closure of these valves are effected by means of one or more camshaft(s). More specifically, the valves are connected to one or more camshafts for synchronizing the movement of the valves in order to successively effect the opening and closure thereof. The angular position of each of the cams on the camshaft is predetermined, allowing the operation of the combustion chambers in a synchronized manner.

In order to allow them to be set in rotation simultaneously, the crankshaft and the camshaft are connected, for example by a belt. As is known, in a four-stroke engine, the camshaft performs one full revolution (from 0° to 360°) when the crankshaft performs two revolutions. This is an engine cycle during which the crankshaft is driven over an angular range varying from 0° to 720° relative to the camshaft. During this engine cycle, the four operating phases are performed for each of the cylinders in a synchronized manner, for example in turn or in pairs.

In a combustion engine, the fuel is introduced into the combustion chamber of each cylinder during the intake phase or the compression phase (depending on the engine speed) by means of an injector mounted on said cylinder and controlled by the vehicle engine control computer.

This fuel injection must take place in the cylinder when the cylinder exhaust valve is closed to avoid unburned fuel flowing into the exhaust system, which could damage the latter.

In order to limit this risk, it is necessary to synchronize the injection of fuel into the combustion chamber at the right time. In other words, the injection of fuel should be synchronized with a predetermined position of the camshaft and therefore of the crankshaft.

Since this synchronization must be carried out when the engine is started, it is therefore necessary to determine the position in which the crankshaft is before the engine is started in order to determine the phase of the cycle in which each of the cylinders is at a given instant, that is to say the configuration (or phase) of the engine at a given instant.

As is known, the position of the crankshaft is determined by a sensor for measuring its angular position over a range of between 0° and 360°. To this end, the crankshaft comprises a toothed wheel having a predetermined number of regularly spaced-apart teeth, and also a tooth-free space corresponding to a position known as the "reference" position of the crankshaft. The sensor is mounted opposite this toothed wheel so as to detect the reference position and count the number of teeth passing in front of the sensor when the crankshaft is rotated.

Similarly, the position of the camshaft can be determined using a toothed wheel mounted on said camshaft and a camshaft sensor arranged opposite said toothed wheel for determining the angular position of the camshaft. The position of the camshaft makes it possible to determine the configuration of the engine and therefore the moments at which the fuel must be injected into the cylinders.

However, in the absence of a camshaft sensor or in the event of a camshaft sensor failure, it is not possible to determine the configuration of the engine and therefore to inject the fuel at the right times into the cylinders.

In order to overcome this drawback, a solution known from FR 2 981 121 B1 consists in deducing the position of the camshaft from a series of hypotheses applied to the position of the crankshaft, each hypothesis being tested by injecting fuel into one or more cylinders. To this end, in this solution, the reference position of the crankshaft is first detected and then this reference position is associated with either the first or the second revolution of the crankshaft in the engine cycle. Fuel is then injected into the cylinders on the basis of this hypothesis and then the torque generated by the combustion of the fuel injected into the cylinders is measured and compared to a predetermined torque value corresponding to an injection of fuel at the expected time in order to determine whether the fuel was indeed injected into the combustion chamber at the desired instant. The operation is then repeated for several injections until the synchronization of the engine is verified.

However, such a method has the major drawback of requiring injection of fuel into the cylinders, which can significantly increase the pollution emitted by the vehicle, or even damage the engine or the exhaust system when the injection is carried out while the exhaust valve is open.

SUMMARY OF THE INVENTION

The invention therefore aims to overcome these drawbacks by proposing a simple, reliable and effective solution for determining the position of the crankshaft of a motor vehicle engine, in particular in the absence or upon failure of a camshaft sensor.

The invention aims in particular both to reduce the level of pollution of the engine and to avoid damaging the engine or the exhaust system of the vehicle.

To this end, the invention firstly relates to a method for determining the configuration of a combustion engine of a motor vehicle, said vehicle comprising a combustion engine comprising a plurality of cylinders, a fuel injection rail for injecting fuel into said cylinders, a high pressure hydraulic injection pump capable of pumping fuel into said injection rail, a control valve for controlling the opening and closing of said injection pump, a measurement sensor for measuring the pressure of the fuel flowing in said injection rail, referred to as a pressure sensor, and a control module, said engine further comprising a crankshaft characterized by its angular position from a reference position and at least one camshaft rigidly connected to said crankshaft such that the crankshaft performs two full revolutions when the at least one camshaft performs one full revolution, said injection pump comprising at least one fuel pumping piston and being mounted synchronously with said crankshaft such that said at least one piston pumps fuel an odd number of times during one revolution of said at least one camshaft, said method being remarkable in that it includes:

- a step of detecting the reference position of the crankshaft,
- a step of controlling, by the control module, the closing of the control valve of the injection pump,
- after a first predetermined time interval, a step of measuring, by the pressure sensor, a fuel pressure value in the injection rail,
- a step of comparing the fuel pressure value measured in the injection rail with a predetermined initial pressure value, and
- a step of determining a first configuration of the engine when the fuel pressure value measured in the injection rail is greater than or equal to a first predetermined pressure threshold or of determining a second configuration of the engine when the fuel pressure value measured in the injection rail is between a second predetermined pressure threshold and a third predetermined pressure threshold.

The terms "engine configuration" or "engine phase" mean the phase of the cycle in which each of the engine cylinders is at a given instant, which corresponds to a given position of the camshaft.

The method according to the invention advantageously makes it possible to determine the position of the crankshaft without injecting fuel into the combustion chambers, thus making it possible to limit the deterioration of the engine and to reduce the polluting emissions from the vehicle.

According to one aspect of the invention, the first time interval corresponds to the time necessary for the crankshaft to be in an angular position offset by a predetermined angle relative to its reference position.

Advantageously, the fuel pressure value measured in the injection rail being between said second predetermined pressure threshold and said third predetermined pressure threshold, the method comprises:

- after a second predetermined time interval, a new step of controlling the control valve of the injection pump,
- a new step of measuring, by the pressure sensor, a fuel pressure value in the injection rail, and
- a step of determining the first configuration of the engine when the fuel pressure value measured in the injection rail is greater than or equal to said first predetermined pressure threshold or of detecting an engine anomaly, when the pressure value measured in the injection rail is lower than the first predetermined pressure threshold.

The term "engine anomaly" means that the position of the camshaft cannot be linked to the position of the crankshaft such that it is not possible to determine the operating phase of the engine. In this case, preferably, the engine is not allowed to start.

Preferably, the second predetermined time interval corresponds to the time interval necessary for the crankshaft to perform one full 360° revolution so as to measure the pressure in the injection rail during the second revolution of the crankshaft, at the instant when it is again in its position corresponding to the offset of the predetermined angular position.

According to one aspect of the invention, the first predetermined threshold corresponds to the predetermined initial pressure plus at least 3 MPa, preferably plus 10 MPa.

Preferably, the second predetermined threshold and the third predetermined threshold correspond to the predetermined initial pressure minus 1 MPa and to the predetermined initial pressure plus 1 MPa, respectively. Thus, the second configuration of the engine is detected when the pressure is similar to the predetermined initial pressure value, that is to say equal to the predetermined initial pressure ±1 MPa.

According to one aspect of the invention, the method comprises, prior to the step of detecting the reference position of the crankshaft, a preliminary step of measuring said initial pressure value in said injection rail.

According to one feature of the invention, as said at least one piston of the injection pump pumps fuel an odd number of times during one revolution of said at least one camshaft, each cam of said camshaft comprises an odd number of lobes. Thus, for one revolution of a camshaft (i.e. one engine cycle), the injection pump comprises an odd number of intake phases and an odd number of injection phases, making it possible to ensure detection of the first or second revolution of the crankshaft depending on whether the injection pump is in an intake phase or an injection phase after detection of the reference position.

According to a preferred aspect of the invention, the first time interval is between 20 and 500 ms, preferably of the order of 70 ms. Such a time interval corresponds to a rotation of the crankshaft, referred to as an offset of the angular position of the crankshaft from the reference position, said offset of the angular position of the crankshaft being between 30° and 240°, preferably of the order of 120°.

Such a first predetermined time interval after which said measurement step is carried out depends on the running speed of the engine. The example of a 70 ms time interval corresponds to the time interval necessary for the crankshaft to perform a rotation of 120° when the engine is running at a speed of 300 rpm, for example when the engine is operating by the starter motor. Such a rotation of 120°, that is to say a rotation of one third of a revolution, corresponds to the offset of the angular position travelled by the crankshaft during the compression phase of the high pressure pump in an engine comprising three cylinders.

Preferably, the second time interval is between 50 and 500 ms, preferably of the order of 200 ms. Such a time interval of 200 ms corresponds to the time necessary to perform one revolution of the crankshaft when the engine is running at a speed of 300 rpm, for example when the engine is operating by the starter motor.

The invention also relates to a system for determining the position of a crankshaft of a combustion engine of a motor vehicle, comprising:

- a combustion engine comprising a plurality of cylinders, a crankshaft characterized by its angular position from a reference position, at least one camshaft rigidly connected to said crankshaft such that the crankshaft performs two full revolutions when said at least one camshaft performs one full revolution, and a position sensor capable of determining the angular position of said crankshaft, an injection module comprising:

a high pressure fuel injection pump comprising at least one fuel pumping piston and being mounted synchronously with said crankshaft such that said at least one piston pumps fuel an odd number of times during one revolution of said at least one camshaft, a control valve configured to control the opening and closing of said injection pump, a fuel injection rail connected on the one hand to said injection pump and on the other hand to a plurality of injectors for injecting the fuel into the cylinders of the engine, a pressure sensor, configured to measure a pressure value in said injection rail, a control module configured to control the opening and closing of said control valve and determine the position of the crankshaft by means of the position sensor and the pressure sensor in order to determine the configuration of the engine.

According to a preferred aspect of the invention, the control module of such a system is configured to:

detect the reference position of the crankshaft on the basis of the crankshaft position sensor, control the control valve of the injection pump so that said control valve closes the injection pump, so as to allow the introduction of fuel into the injection rail, after a first predetermined time interval, measure, via the pressure sensor, a fuel pressure value in the injection rail, and determine a first configuration or a second configuration of the engine depending on whether the fuel pressure value measured in the injection rail is greater than or equal to a first predetermined pressure threshold, or between a second predetermined pressure threshold and a third predetermined pressure threshold, respectively.

According to one aspect of the invention, the first time interval corresponds to the time necessary for the crankshaft to be in an angular position offset by a predetermined angle relative to its reference position.

Advantageously, the fuel pressure value measured in the injection rail being between said second predetermined pressure threshold and said third predetermined pressure threshold, the control module is configured to:

after a second predetermined time interval, control the control valve of the injection pump, measure, via the pressure sensor, a fuel pressure value in the injection rail, and determine the first configuration of the engine when the fuel pressure value measured in the injection rail is greater than or equal to said first predetermined pressure threshold, or detect an engine anomaly when the pressure value measured in the injection rail is lower than the first predetermined pressure threshold.

Preferably, the second predetermined time interval corresponds to the time interval necessary for the crankshaft to perform one full 360° revolution so as to measure the pressure in the injection rail during the second revolution of the crankshaft, at the instant when it is again in its position corresponding to the offset of the predetermined angular position.

According to one aspect of the invention, the first predetermined threshold corresponds to the predetermined initial pressure plus at least 3 MPa, preferably plus 10 MPa.

Preferably, the second predetermined threshold and the third predetermined threshold correspond to the predetermined initial pressure minus 1 MPa and to the predetermined initial pressure plus 1 MPa, respectively. Thus, the second configuration of the engine is detected when the pressure is similar to the predetermined initial pressure value, that is to say equal to the predetermined initial pressure ±1 MPa.

According to one aspect of the invention, the control module is configured to measure the initial pressure value in said injection rail.

According to one feature of the invention, as said at least one piston of the injection pump pumps fuel an odd number of times during one revolution of said at least one camshaft, each cam of said camshaft comprises an odd number of lobes. Thus, for one revolution of a camshaft (i.e. one engine cycle), the injection pump comprises an odd number of intake phases and an odd number of injection phases, making it possible to ensure detection of the first or second revolution of the crankshaft depending on whether the injection pump is in an intake phase or an injection phase after detection of the reference position.

According to a preferred aspect of the invention, the first time interval is between 20 and 500 ms, preferably of the order of 70 ms. Such a time interval corresponds to a rotation of the crankshaft, referred to as an offset of the angular position of the crankshaft from the reference position, said offset of the angular position of the crankshaft being between 30° and 240°, preferably of the order of 120°.

Such a first predetermined time interval after which said measurement step is carried out depends on the running speed of the engine. The example of a 70 ms time interval corresponds to the time interval necessary for the crankshaft to perform a rotation of 120° when the engine is running at a speed of 300 rpm, for example when the engine is operating by the starter motor. Such a rotation of 120°, that is to say a rotation of one third of a revolution, corresponds to the offset of the angular position travelled by the crankshaft during the compression phase of the high pressure pump in an engine comprising three cylinders.

Preferably, the second time interval is between 50 and 500 ms, preferably of the order of 200 ms. Such a time interval of 200 ms corresponds to the time necessary to perform one revolution of the crankshaft when the engine is running at a speed of 300 rpm, for example when the engine is operating by the starter motor.

Lastly, the invention relates to a motor vehicle comprising a system for determining the configuration of a combustion engine as described above.

DESCRIPTION OF THE PREFERRED EMBODIMENTS

The invention will be presented below for the purpose of implementation in a motor vehicle. However, any implementation in a different context, in particular for any vehicle comprising a combustion engine whose configuration it is necessary to determine is also covered by the invention. Likewise, the invention will be described with the aid of an example in which the injection of fuel into a combustion chamber is synchronized with the opening of the intake valve connected to this same intake chamber, that is to say during the intake phase of this combustion chamber; however, such synchronization could also be carried out during another operating phase, depending on the type of engine concerned.

1/System

Figure 1:
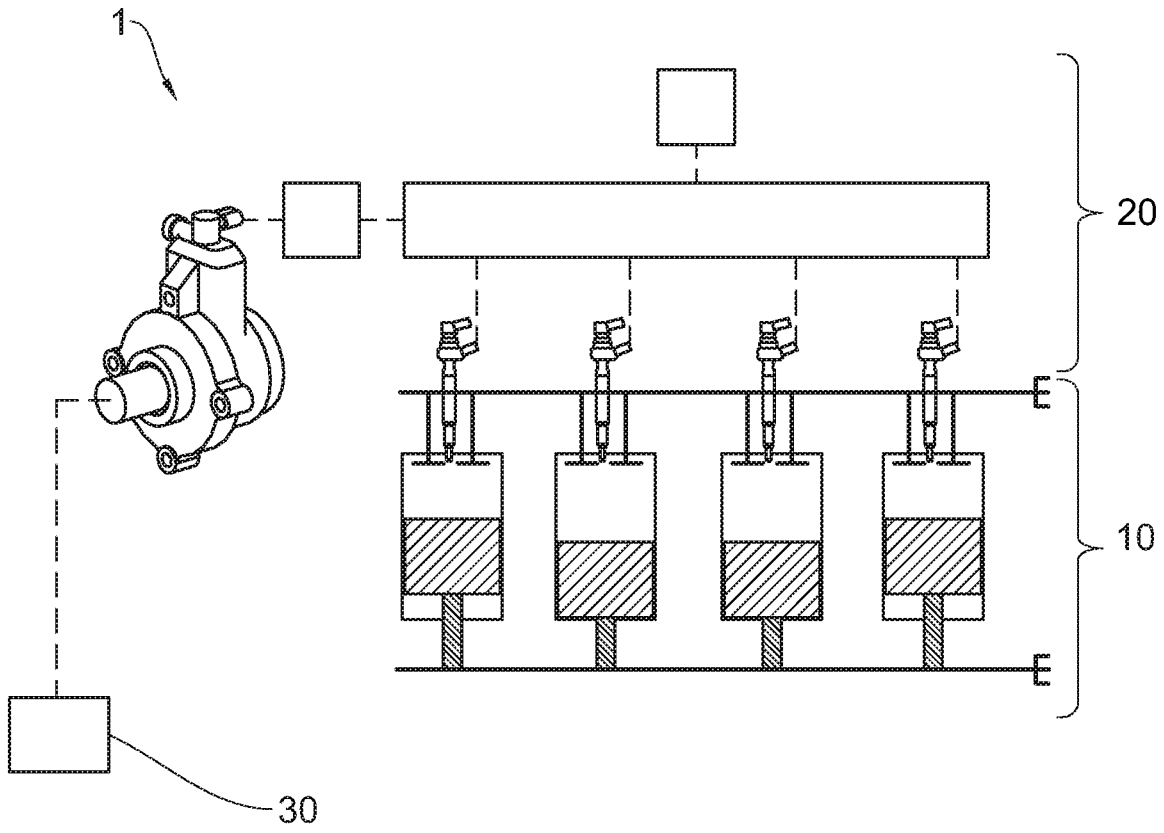
FIG. 1 schematically illustrates one embodiment of the system according to the invention.

With reference to FIG. 1, the system 1, according to one form of representation of the invention, comprises a motor vehicle combustion engine 10, an injection module 20 and a control module for controlling the injection module 20, in this case in the form of a computer 30.

a. Engine 10

Figure 2:
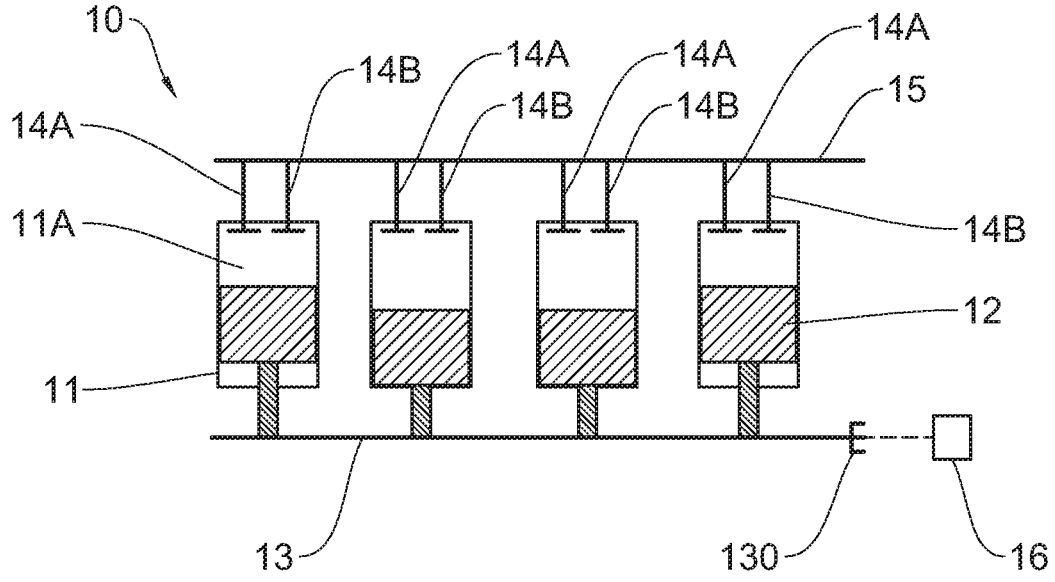
FIG. 2 is a schematic view of the system in FIG. 1, detailing the engine of the vehicle.

As shown schematically in FIG. 2, the combustion engine 10 comprises, in a known way, a plurality of cylinders 11 each delimiting a combustion chamber 11A in which a piston 12 slides, the movement of the piston being driven by compression and expansion of the gases resulting from the compression of a mixture of air and fuel introduced into the combustion chambers 11A.

As a reminder, the air and the gases are introduced and expelled respectively via intake valves 14A and exhaust valves 14B, which are connected, in this example, to a single camshaft 15. However the engine 10 of the vehicle could just as easily comprise two camshafts 15, one for the intake valves 14A and the other for the exhaust valves 14B. Similarly, in this example, each cylinder 11 is connected to one intake valve 14A and one exhaust valve 14B; however, each cylinder 11 could also be connected to several intake valves 14A and several exhaust valves 14B. The camshaft 15, rotated, alternately allows the opening and closing of the intake and exhaust valves 14 of each combustion chamber 11A.

The set of pistons 12 is connected to a crankshaft 13, which is rotated by the thrust of each piston 12, thus driving the rotation of the wheels of a vehicle. The crankshaft 13 comprises a toothed wheel 130 having a predetermined number of regularly spaced-apart teeth, and also a tooth-free space corresponding to a reference position $D_0$ of the crankshaft 13. Since such a toothed wheel 130 is known per se, it will not be described in more detail here.

A position sensor 16 is mounted next to the toothed wheel 130 so as to allow the detection of the reference position $D_0$ and the counting of the number of teeth passing in front of the position sensor 16 from the reference position $D_0$ by the computer 30 when the crankshaft 13 is driven in rotation. More specifically, the position sensor 16 delivers a signal representative of the passage of the teeth which allows the computer 30 to determine the angular position from 0° to 360° of the crankshaft 13. As an alternative, the position sensor 16 could itself detect the reference position $D_0$, count the teeth and send this information to the computer 30 without this limiting the scope of the present invention.

When the camshaft 15 and the crankshaft 13 are rotated, the camshaft 15 performs a full revolution from 0° to 360° while the crankshaft 13 performs two revolutions. This, as is known, is an engine cycle ranging from 0° to 720° in which four operating phases are performed for each of the combustion chambers 11A, for example in turn.

To be specific, each combustion chamber 11A of the cylinders 11 of the engine 10 successively comprises the following operating phases: a phase of intake of air and fuel into the combustion chamber 11A, a phase of compression of the mixture until combustion thereof, a phase of expansion of the gases resulting from said combustion and a phase of exhaust of the gases out of the combustion chamber 11A.

b. Injection Module 20

The injection module 20 makes it possible to introduce the fuel into the combustion chambers 11A. In this example, the system 1 according to the invention makes it possible to synchronize the instant of injection of fuel into a combustion chamber 11A with the opening of the intake valve 14A of this same combustion chamber 11A. However, depending on the type of engine, the instant of injection of fuel could just as well be synchronized with another phase of the combustion chamber 11A, for example at the end of the combustion phase.

Figure 3:
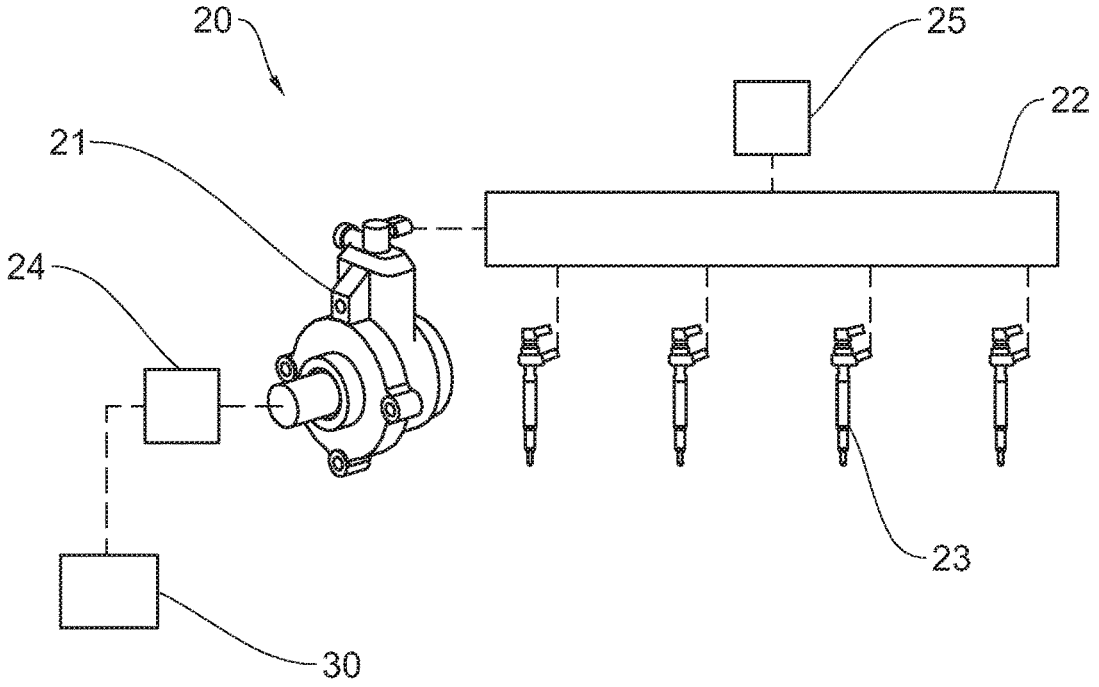
FIG. 3 is a schematic view of the system in FIG. 1, detailing the injection module.

To achieve this synchronization, the injection module 20 is connected to the computer 30, for example the main computer of the vehicle, and comprises, with reference to FIG. 3, an injection pump 21, configured to pump fuel into an injection rail 22, connected to a plurality of injectors 23. The injection module 20 further comprises a control valve 24 for controlling the opening and closing of the injection pump 21, and a pressure sensor 25.

Preferably, the injection pump 21 comprises one or more internal piston(s) 210 (not shown), generally one piston 210, configured to control the flow of fuel, thereby regulating the pressure in the injection module 20.

Figure 4A:
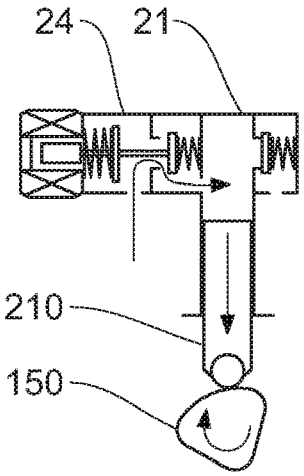
FIGS. 4A to 4C schematically illustrate an example of the operation of a piston pump actuated by a cam comprising three lobes.
Figure 4B:
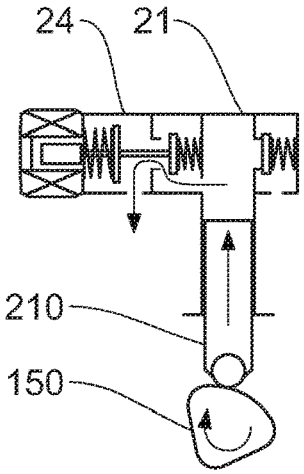
Figure 4C:
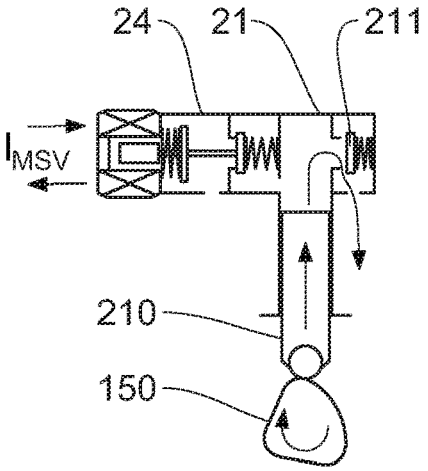

To this end, as shown in the example of FIGS. 4A, 4B and 4C, such a piston 210 slides regularly in the injection pump 21 The piston 210 is thus configured to move regularly in the injection pump 21, in order to allow the introduction (FIG. 4A) of fuel into the injection pump 21, then discharge of the fuel (FIG. 4B). As the control valve 24 is open, the injection pump 21 is thus not pressurized.

To be specific, the fuel is introduced into the injection pump 21 via a control valve 24 for opening and closing the injection pump 21, thus making it possible to control the flow of fuel. Thus, when the control valve 24 is open, as shown in FIGS. 4A and 4B, the movement of the piston 210 causes the fuel to be introduced and discharged, without a rise in pressure in the injection pump 21. However, when the control valve 24 is closed, as shown in FIG. 4C, the piston 210 compresses the fuel introduced into the injection pump 21, the pressure increases, causing the opening of a valve 211 for connection with the injection rail 22, causing the introduction of fuel into the injection rail 22 and thus the rise in pressure inside the injection rail 22.

Such a control valve 24 is preferably a digital flow valve, allowing more precise control of the flow of fuel in the injection pump 21 and thus regulation of the pressure in the injection rail 22. In addition, in this example, the control valve 24 is included in the injection pump 21; however, it goes without saying that the control valve 24 could be external to the injection pump 21, as shown in FIG. 3.

In a preferred embodiment, the sliding movement of the piston 210 in the injection pump 21 is driven by a cam 150 of the camshaft 15 in rotation. However, the injection pump 21 could equally well include a rotary piston 210 comprising a plurality of lobes. In this example, the number of lobes of the rotary piston 210 would be odd.

To be specific, in a preferred embodiment of the invention, during an engine cycle from 0° to 720°, the injection pump 21 is configured to allow the injection of fuel into the injection rail 22 an odd number of times. By way of example, the piston 210 of the injection pump 21 is configured to pump fuel three times during the engine cycle. The succession of six slides (for example three rises and three descents) of the piston 210 during an engine cycle thus allows three rises in pressure of the injection pump 21, and therefore three rises in pressure in the injection rail 22, during this engine cycle.

The injection pump 21 is configured to operate in synchronization with the crankshaft 13. In particular, the injection pump 21 is configured to rise in pressure, by means of the control valve 24, in synchronization with one or more defined positions of the crankshaft 13.

To be specific, during an engine cycle, as the crankshaft 13 performs two revolutions, the position sensor 16 is configured to detect the reference position $D_0$ twice. In this example, when the control valve 24 is closed, as the cam 150 actuating the piston 210 of the injection pump 21 comprises three lobes, the first reference position $D_0$ of the crankshaft 13 corresponds to a high position of the piston 210 and therefore to an increase in the pressure in the injection pump 21 and hence in the injection rail 22, while the second reference position $D_0$ corresponds to a low position of the piston 210 and therefore to a value P of constant pressure of the fuel in the injection rail 22.

Such an injection rail 22 is configured to allow the distribution of fuel, coming from the injection pump 21, into the set of cylinders 11 of the engine 10 via injectors 23.

The injector 23 of the combustion chamber 11A of which the intake valve 14A is open is activated so as to allow, in this example, the simultaneous intake of the mixture of air and fuel into the combustion chamber 11A.

In order to allow the implementation of the invention, the injection module 20 comprises a pressure sensor 25, connected to the injection rail 22 and configured to measure a pressure value P in the injection rail 22. Such a pressure sensor 25 is configured to transmit the pressure measurement values P to the computer 30 of the vehicle.

Figure 5:
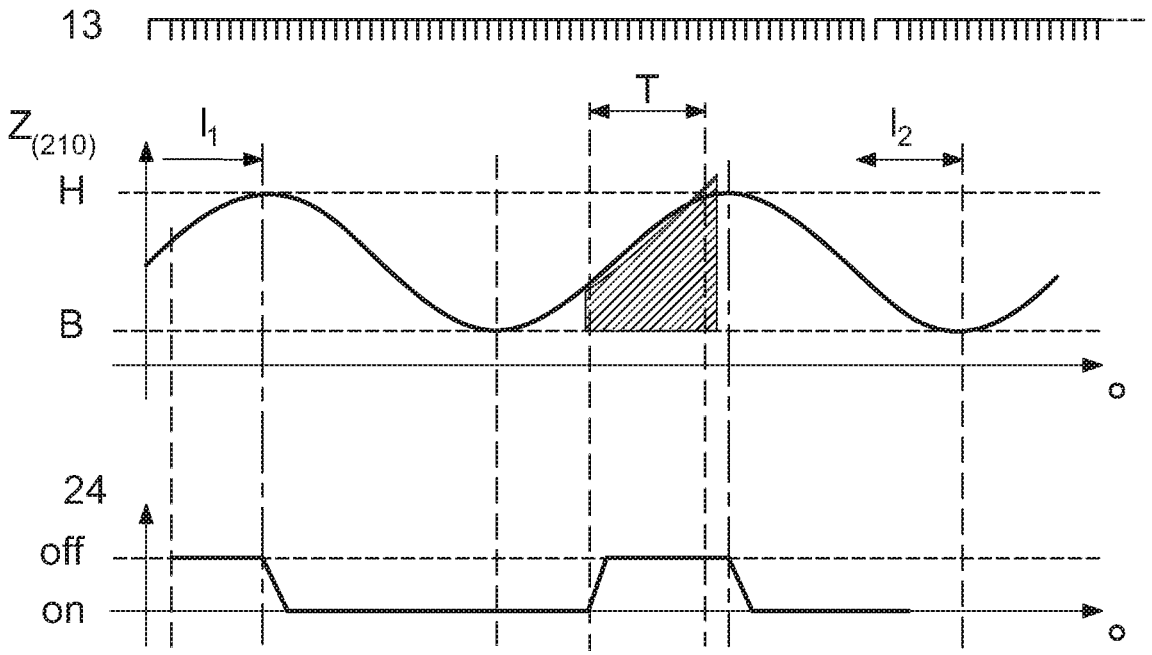
FIG. 5 depicts on a graph the evolution of the position of the piston in the high pressure pump during half of an engine cycle as a function of an open and closed state of the control valve connected to the injection pump, allowing the injection of fuel into the injection rail.

To be specific, with reference to FIG. 5, during its operation, the position Z of the piston 210 of the injection pump 21 alternates successively between a high position H and a low position B. When the control valve 24 is closed (OFF), the high position H of the piston 210 corresponds to a first phase $I_1$ of injection of fuel into the injection rail 22 during which the pressure in the injection rail 22 increases, and the low position B to a second phase $I_2$ during which the fuel is not compressed in the injection pump 21, not resulting in the injection of fuel into the injection rail 22 in which the pressure then remains constant.

Indeed, when the control valve 24 is open, the pressure in the injection pump 21 and therefore in the injection rail 22 corresponds to a minimum pressure referred to as the predetermined initial pressure $P_i$ which is generally close to atmospheric pressure. When the control valve 24 is closed, two cases arise: if the piston 210 of the injection pump 21 is in the low position B, that is to say the fuel is not compressed by the piston 210, then the pressure value P in the injection rail 22 is equivalent to the predetermined initial pressure $P_i$; likewise, if the piston 210 is in the high position H, that is to say the fuel is compressed by the piston 210, then the pressure value P in the injection pump 21 and therefore in the injection rail 22 is greater than the predetermined initial pressure $P_i$.

In this example, in which the piston 210 of the injection pump 21 is configured to pump fuel three times during a complete engine cycle, the first revolution and the second revolution of the crankshaft 13, each corresponding to half of an engine cycle, each thus correspond to a different position of the piston 210. In fact, when the control valve 24 is closed, if the crankshaft 13 is in its first revolution of rotation, then the piston 210, synchronized with the crankshaft 13, is configured to be in the first phase $I_1$ of rising to the high position H, in which the pressure value P measured in the injection rail 22 is greater than the predetermined initial pressure $P_i$. Likewise, if the crankshaft 13 is in its second revolution of rotation, then the piston 210 is configured to be in the second phase $I_2$ of descent to the low position B, in which the pressure value P measured in the injection rail 22 is similar to the predetermined initial pressure $P_i$. "Similar" means in this example that the pressure value P is equal to the predetermined initial pressure $P_i \pm 1$ MPa (megapascal).

The odd number of phases $I_1$ during which the piston 210 pumps fuel into the injection rail 22 during a complete engine cycle thus makes it possible to ensure that the fuel pressure in the injection rail 22 is different for the same angular position of the crankshaft 13 during two consecutive revolutions of said crankshaft 13, corresponding to two different configurations of the engine 10.

c. Computer 30

The computer 30, for example the main computer of the vehicle, makes it possible to control the injection of fuel into a defined combustion chamber 11A at a precise instant. To this end, the computer 30 is configured to control the control valve 24 in order to control the flow of fuel into the injection pump 21 and to control the closing of such an injection pump 21, allowing the introduction of fuel into the injection rail 22. In other words, the computer 30 is configured to control the pumping of fuel into the injection rail 22 by means of the injection pump 21 controlled by the control valve 24 at a given instant corresponding to the predetermined position of the crankshaft 13 known and described previously.

Lastly, the computer 30 of the vehicle is configured to receive the data supplied by the position sensor 16 of the crankshaft 13 and by the pressure sensor 25 of the injection rail 22.

2/Method

Figure 6:
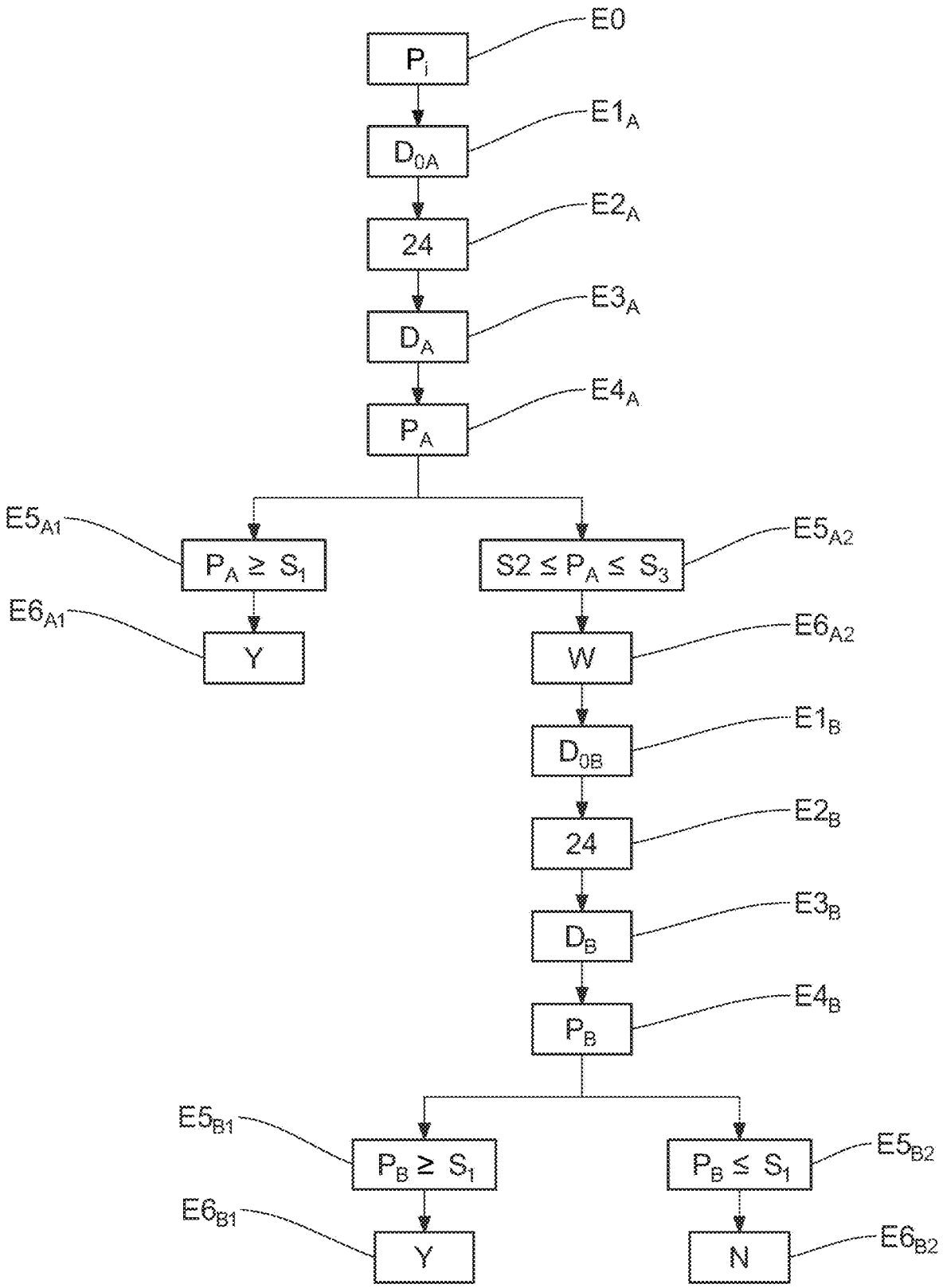
FIG. 6 schematically illustrates one embodiment of the method according to the invention.

The invention will now be described in an exemplary embodiment with reference to FIGS. 5 and 6. The method for determining the position of the crankshaft 13 makes it possible to determine the synchronization of the engine 10. As the crankshaft 13 and the camshaft 15 are connected so as to allow simultaneous rotation, such a method could in an equivalent manner be described for determining the position of the camshaft 15, the position of which can be ascertained by means of the position sensor 16 of the crankshaft 13.

In this example, the method firstly comprises a step E0 of starting up the engine 10, making it possible to actuate the rotation of the camshaft 15 and of the crankshaft 13. An initial pressure value $P_i$ is then measured in the injection rail 22 by means of the pressure sensor 25.

The position sensor 16 then detects, in a step $E1_A$, the reference position $D_{0A}$ of the crankshaft 13, by detecting the tooth-free space on the toothed wheel 130. A signal of detection of a tooth of the toothed wheel 130 is thus regularly sent to the computer 30.

In this example, the position sensor 16 detects each tooth of the toothed wheel 130 and regularly transmits to the computer 30 a signal of detection of the presence of a tooth. The computer 30 then detects the reference position $D_0$ of the crankshaft 13 when no signal is sent by the position sensor 16 for a predetermined period. However, it goes without saying that the position sensor 16 could equally well directly detect the reference position $D_0$ of the crankshaft 13 and transmit a signal of detection of such a reference position $D_0$ to the computer 30, for example.

When the computer 30 detects the reference position $D_{0A}$ of the crankshaft 13, said computer 30 commands, for example, the closing of the control valve 24, in a step $E2_A$. Alternatively, the closing of the control valve 24 may be commanded by the computer 30 after a predetermined time interval, depending on the arrangement of the injection pump 21. The computer 30 then detects, in a step $E3_A$, an angular rotation of the crankshaft 13, referred to as the offset $D_A$ of the angular position of the crankshaft 13, from the reference position $D_{0A}$. Such an offset $D_A$ of the angular position of the crankshaft 13 is between 30° and 240°, preferably 120° in the example of an engine operating by means of a starter motor and thus running at a rotation speed of 300 rpm, and corresponds to a time interval. The computer 30 could thus also trigger a time delay T, the duration of which corresponds to a predetermined time interval, for example 10 milliseconds. As shown in the graph in FIG. 5, this time delay T corresponds to the time elapsing between the detection of the reference position $D_0$ and the instant at which the piston 210 of the injection pump 21 is in the high position H.

In a step $E4_A$, the pressure sensor 25 measures the pressure in the injection rail 22 and transmits the pressure value $P_A$ measured to the computer 30.

Thus, when the computer 30 controls the control valve 24 of the injection pump 21 so that said injection pump 21 injects fuel into the injection rail 22, the pressure value $P_A$ of the fuel in the injection rail 22, measured at the end of the offset $D_A$ of the angular position of the crankshaft 13, has increased to reach a maximum if the engine 10 is in a first configuration, or has remained constant, if the engine 10 is in a second configuration.

The pressure value $P_A$ is then compared with the predetermined initial pressure value $P_i$.

When the pressure value $P_A$ measured in step $E4_A$ is greater than a first predetermined threshold $S_1$ as in a step $E5_{A1}$, for example equal to the predetermined initial pressure $P_i$ plus at least 3 MPa, preferably 10 MPa, then the computer 30 deduces therefrom, in a step $E6_{A1}$, that the engine 10 is in the first configuration, that is to say that the crankshaft 13 is indeed in its first revolution. The engine 10 is synchronized (Y).

When the pressure value $P_A$ measured in step $E4_A$ is between a second predetermined threshold $S_2$ and a third predetermined threshold $S_3$ in a step $E5_{A2}$, then the computer 30 deduces therefrom, in the step $E6_{A2}$, either that the engine 10 is in the second configuration, that is to say that the crankshaft 13 is in its second revolution, or that the engine 10 is out of synchronization and has an anomaly (W). In this example, the second predetermined threshold $S_2$ and the third predetermined threshold $S_3$ correspond respectively to the predetermined initial pressure $P_i$ minus 1 MPa and to the predetermined initial pressure $P_i$ plus 1 MPa. In other words, it is said that the pressure value $P_A$ measured is similar to the predetermined initial pressure $P_i$, that is to say for example equal to the predetermined initial pressure $P_i$ ±1 MPa.

In the latter case, the method then comprises a new step $E1_B$ of detecting the second reference position $D_{0B}$ of the crankshaft 13, corresponding to the next revolution of the crankshaft 13, followed by a new step $E2_B$ of closing the control valve 24. After a second offset $D_B$ of the angular position of the crankshaft 13 or a second predetermined time interval (step $E3_B$), the pressure in the injection rail 22 is again measured in a new step $E4_B$ and compared with the predetermined initial pressure $P_i$. If the pressure value $P_B$ measured is greater than or equal to the first predetermined threshold $S_1$ in a step $E5_{B1}$, then the engine is indeed in its first configuration, that is to say the crankshaft 13 is indeed in its first revolution. The method includes a step $E6_{B1}$ of validating the synchronization of the engine 10 (Y). If the pressure value $P_B$ measured is lower than the first predetermined threshold $S_1$ in a step $E5_{B2}$, then the method detects that the engine 10 is out of synchronization and has an anomaly (N) in a step $E6_{B2}$.

Such a method advantageously makes it possible to determine the position of the crankshaft and hence the operating phase of the engine, thus making it possible to synchronize the engine without the need for fuel injection. The method according to the invention thus makes it possible to limit the deterioration of the exhaust system as well as the pollution emitted by the vehicle.

The invention claimed is:

1. A method for determining the configuration of a combustion engine (10) of a motor vehicle, where the engine (10) has a plurality of cylinders (11) in connection with a crankshaft (13), a camshaft (15), a fuel injection rail (22) for injecting fuel into said cylinders (11), a high pressure hydraulic injection pump (21) that pumps fuel into said injection rail (22), a control valve (24) that controls opening and closing of said injection pump (21), a pressure sensor (25) that measures pressure of fuel flowing in said injection rail (22), and a control module (30), said crankshaft (13) having an angular position from a reference position ($D_0$), said camshaft (15) being rigidly connected to the crankshaft (13) such that the crankshaft (13) performs two full revolutions when the camshaft (15) performs one full revolution, and said injection pump (21) equipped with a fuel pumping piston (210) that operates synchronously with said crankshaft (13) such that said fuel pumping piston (210) pumps fuel an odd number of times during one revolution of said camshaft (15), said method comprising:

detecting ($E1_A$) the reference position ($D_0$) of the crankshaft (13);

causing ($E2_A$), by the control module (30), the control valve (24) of the injection pump (21) to close;

after a first predetermined time interval, of measuring ($E4_A$) by the pressure sensor (25) a first fuel pressure value (P) in the injection rail (22);

comparing the first fuel pressure value (P) measured in the injection rail (22) with a predetermined initial pressure value ($P_i$), the engine (10) determined to be in a first configuration when the fuel pressure value (P) measured in the injection rail (22) is greater than or equal to a first predetermined pressure threshold ($S_1$), and in a second configuration when the fuel pressure value (P) measured in the injection rail (22) is between a second predetermined pressure threshold ($S_2$) and a third predetermined pressure threshold ($S_3$);

measuring ($E4_B$), when the first fuel pressure value (P) measured in the injection rail (22) is between the second predetermined pressure threshold ($S_2$) and the third predetermined pressure threshold ($S_3$) by the pressure sensor (25), a second fuel pressure value ($P_B$) in the injection rail (22) after a second predetermined time interval; and determining the engine to be in the first configuration of the engine (10) when the second fuel pressure value ($P_B$) measured in the injection rail (22) is greater than or equal to said first predetermined pressure threshold ($S_1$), and detecting an engine anomaly when the second pressure value ($P_B$) measured in the injection rail (22) is lower than the first predetermined pressure threshold ($S_1$).

2. The method as claimed in claim 1, wherein the first predetermined threshold ($S_1$) corresponds to the predetermined initial pressure ($P_i$) plus at least 3 MPa.

3. The method as claimed in claim 1, wherein the second predetermined threshold ($S_2$) and the third predetermined threshold ($S_3$) correspond to the predetermined initial pressure ($P_i$) minus 1 MPa and to the predetermined initial pressure ($P_i$) plus 1 MPa, respectively.

4. The method as claimed in claim 1, further comprising, prior to the step of detecting the reference position (Do) of the crankshaft (13):

measuring said initial pressure value ($P_i$) in said injection rail (22).

5. The method as claimed in claim 1, wherein, as said at least one piston (210) of the injection pump (21) pumps fuel an odd number of times during one revolution of said at least one camshaft (15), each cam of said camshaft (15) comprises an odd number of lobes.

6. The method as claimed in claim 1, wherein the first time interval is between 20 and 500 ms.

7. A system (1) for determining a position of a crankshaft (13) of a combustion engine (10) of a motor vehicle, where the combustion engine (10) includes a plurality of cylinders (11), a crankshaft (13) having an angular position from a reference position ($D_0$), a camshaft (15) rigidly connected to said crankshaft (13) such that the crankshaft (13) performs two full revolutions when said at least one camshaft (15) performs one full revolution, and a position sensor (16) that determines an angular position of said crankshaft (13), the system comprising:

an injection module (20), comprised of:

a high pressure fuel injection pump (21) with at least one fuel pumping piston (210) being mounted synchronously with said crankshaft (13) such that said at least one piston (210) pumps fuel an odd number of times during one revolution of said at least one camshaft (15), a control valve (24) configured to control opening and closing of said injection pump (21), a fuel injection rail (22) connected both to said injection pump (21) and to a plurality of injectors (23) for injecting the fuel into the cylinders (11) of the engine (10), and a pressure sensor (25), configured to measure a pressure value (P) in said injection rail (22); and a control module (30) configured to control the opening and closing of said control valve (24) and to determine the position of the crankshaft (13) by means of the position sensor (16) and the pressure sensor (25) in order to determine the configuration of the engine (10), the control module configured to:

detect the reference position ($D_0$) of the crankshaft (13), cause the control valve (24) of the injection pump (21) to close, after a first predetermined time interval, measure by the pressure sensor (25) a first fuel pressure value (P) in the injection rail (22);

compare the first fuel pressure value (P) measured in the injection rail (22) with a predetermined initial pressure value ($P_i$), the engine (10) determined to be in a first configuration when the fuel pressure value (P) measured in the injection rail (22) is greater than or equal to a first predetermined pressure threshold ($S_1$), and in a second configuration when the fuel pressure value (P) measured in the injection rail (22) is between a second predetermined pressure threshold ($S_2$) and a third predetermined pressure threshold ($S_3$), measure, when the first fuel pressure value (P) measured in the injection rail (22) is between the second predetermined pressure threshold ($S_2$) and the third predetermined pressure threshold ($S_3$) by the pressure sensor (25), a second fuel pressure value ($P_B$) in the injection rail (22) after a second predetermined time interval, and determine the engine to be in first configuration of the engine (10) when the second fuel pressure value ($P_B$) measured in the injection rail (22) is greater than or equal to said first predetermined pressure threshold ($S_1$), and detecting an engine anomaly when the second pressure value ($P_B$) measured in the injection rail (22) is lower than the first predetermined pressure threshold ($S_1$).

8. A motor vehicle, comprising the system (1) for determining a position of a crankshaft (13) of a combustion engine (10) as claimed in claim 7.

9. The method as claimed in claim 1, wherein the first predetermined threshold ($S_i$) corresponds to the predetermined initial pressure ($P_i$) plus 10 MPa.

10. The method as claimed in claim 1, wherein the first time interval is 70 ms.

11. The method as claimed in claim 2, wherein the second predetermined threshold ($S_2$) and the third predetermined threshold ($S_3$) correspond to the predetermined initial pressure ($P_i$) minus 1 MPa and to the predetermined initial pressure ($P_i$) plus 1 MPa, respectively.

12. The method as claimed in claim 2, further comprising, prior to the step of detecting the reference position ($D_0$) of the crankshaft (13):

measuring said initial pressure value ($P_i$) in said injection rail (22).

13. The method as claimed in claim 3, further comprising, prior to the step of detecting the reference position ($D_0$) of the crankshaft (13):

measuring said initial pressure value ($P_i$) in said injection rail (22).

14. The method as claimed in claim 2, wherein, as said at least one piston (210) of the injection pump (21) pumps fuel an odd number of times during one revolution of said at least one camshaft (15), each cam of said camshaft (15) comprises an odd number of lobes.

15. The method as claimed in claim 3, wherein, as said at least one piston (210) of the injection pump (21) pumps fuel an odd number of times during one revolution of said at least one camshaft (15), each cam of said camshaft (15) comprises an odd number of lobes.

* * * * *